US005277503A

United States Patent [19]

Nagao

[11] Patent Number: 5,277,503

[45] Date of Patent: Jan. 11, 1994

[54] TAPE CASSETTE BUILT INTO A TAPE WRITER

[75] Inventor: Yoshiaki Nagao, Tsushima, Japan

[73] Assignee: Brother Kogyo Kabushiki Kaisha, Nagoya, Japan

[21] Appl. No.: 905,517

[22] Filed: Jun. 29, 1992

[30] Foreign Application Priority Data

Jul. 22, 1991 [JP] Japan ..... 3-181188

[51] Int. Cl.[5] ..... B41J 35/28

[52] U.S. Cl. ..... 400/208; 242/197

[58] Field of Search ..... 400/207, 207E, 208, 208.1, 247, 194, 196-197, 692, 703; 242/197, 242/198, 199, 200

[56] References Cited

U.S. PATENT DOCUMENTS

| | | | |
|---|---|---|---|
| 4,531,690 | 7/1985 | Condy | 242/197 |
| 4,605,325 | 8/1986 | Hofmann | 400/207 |
| 4,836,698 | 6/1989 | Takagi et al. | 400/208 |
| 4,927,278 | 5/1990 | Kuzuya et al. | 400/208 |
| 5,022,771 | 6/1991 | Paque | 400/120 |
| 5,073,052 | 12/1991 | Daley et al. | 400/208 |

FOREIGN PATENT DOCUMENTS

| | | | |
|---|---|---|---|
| 3005260 | 8/1981 | Fed. Rep. of Germany . | |
| 2496010 | 6/1982 | France | 400/208 |
| 0074181 | 5/1982 | Japan | 400/207 E |
| 0078879 | 5/1984 | Japan | 400/207 E |
| 0222380 | 12/1984 | Japan | 400/207 E |
| 60-15188 | 1/1985 | Japan . | |
| 1-195088 | 8/1989 | Japan | 400/208 |
| 2-241780 | 9/1990 | Japan . | |
| 2223740 | 4/1990 | United Kingdom . | |

*Primary Examiner*—Edgar S. Burr
*Assistant Examiner*—Christopher A. Bennett
*Attorney, Agent, or Firm*—Oliff & Berridge

[57] ABSTRACT

Different kinds of upper casings and different kinds of lower casings can be combined with each other. A tape cassette is formed by combining an upper casing and a lower casing corresponding to tape width of tapes (film tape, double-coated adhesive tape, heat transfer ribbon). A first projection part indicating to a kind of upper casing is formed on the upper casing and a second projection part indicating to a kind of lower casing is formed on the lower casing. The kind of tape cassette can be identified by the first projection part and second projection part.

20 Claims, 9 Drawing Sheets

FIG. 7(b)

| ITEM | START |
|---|---|
| S71 | IDENTIFY INSTALLED TAPE CASSETTE |
| S72 | SIZE OF INPUT CHARACTERS FIT IN TAPE SIZE OF INSTALLED TAPE CASSETTE? |
| S73 | PRINT CHARACTERS |
| S74 | DISPLAY ERROR MESSAGE |

TAPE CASSETTE BUILT INTO A TAPE WRITER

BACKGROUND OF THE INVENTION

1. Field of the Invention

The present invention relates to a tape cassette built in a tape writer for printing desired characters, symbols, etc. on a tape.

2. Description of Related Art

Two kinds of tapes of, for example, 12 mm and 9 mm width have been used as tapes installed in a tape cassette which is to be attached to a tape writer for making a tape on which desired characters or symbols are printed. Four kinds of cassette casings comprising an upper casing and a lower casing corresponding to a tape of 12 mm width and an upper casing and a lower casing corresponding to a tape of 9 mm width are required to form a tape cassette for storing tapes of 12 mm width and 9 mm width, respectively. Each of the tape cassettes are formed by combining an upper casing and a lower casing corresponding to the tape width.

However, if an upper casing and a lower casing are required for each of tapes of two different widths, two kinds of upper casings and two kinds of lower casings are required to form cassette casings for the tapes of two different tape widths. That is, four kinds of casings are required in all. If a tape cassette is formed by an upper casing and a lower casing for each of tapes of different widths, more than three kinds of upper casings and more than three kinds of lower casings are required to make printed tapes of more than three kinds of widths.

If the kinds of upper casings and lower casings increases, manufacturing means for each casing is required and it takes much time and labor to manufacture upper casings and lower casings. Another problem exists wherein, for example, much labor is required to manage many kinds of upper casings and lower casings.

SUMMARY OF THE INVENTION

An object of the present invention is to provide a tape cassette with which manufacturing means for upper casings and lower casings and manufacturing labor can be reduced and the management of upper casings and lower casings can be simplified.

In order to achieve the above and other objects, and to overcome the shortcomings discussed above, a tape cassette is provided comprising: a tape on which characters or symbols are printed, an upper casing having a shape corresponding to the width of the tape, and a lower casing having a shape corresponding to the width of the tape for storing a tape combined with an upper casing.

The tape cassette further comprises: a first projection part disposed on an upper casing of said tape cassette for detection by a distinction means of an upper casing of a tape writer corresponding to the shape of the upper casing and a second projection part disposed on the lower casing for detection by a distinction means of a lower casing of the tape writer corresponding to the shape of the lower casing.

In a tape cassette constructed as described above, according to the present invention, characters or symbols are printed on a tape, an upper casing having a shape corresponding to the width of the tape stores the tape in combination with a lower casing, the lower casing having a shape corresponding to the width of the tape, the lower casing stores a tape in combination with the upper casing, and a tape cassette stores a tape by exchanging either one of the upper casing or the lower casing with the upper casing or the lower casing of a shape corresponding to the tape width to combine with the lower casing or upper casing.

A first projection part disposed on an upper casing of the tape cassette is detected by a distinction means of an upper casing of the tape writer corresponding to the shape of the upper casing, and a second projection part disposed on the lower casing is detected by a distinction means of a lower casing of the tape writer corresponding to the shape of the lower casing.

As is clear from above, since a tape cassette of the present invention is formed by combining various kinds of upper casings and various kinds of lower casings, and a tape cassette of the present invention requires almost half of the kinds of previously required upper casings and lower casings, manufacturing means of the upper casings and the lower casings and manufacturing labor can be reduced, and the management of the upper casings and the lower casings can be simplified.

BRIEF DESCRIPTION OF THE DRAWINGS

A preferred embodiment of the present invention will be described in detail with reference to the following drawings wherein:

FIG. 1(*b*) is a cross-sectional view of a cassette casing storing a tape of 18 mm width;

FIG. 1(*c*) is a cross-sectional view of a cassette casing storing a tape of 12 mm width;

FIG. 1(*d*) is a cross-sectional view of a cassette casing storing a tape of 6 mm width;

FIG. 7(*b*) is a table describing the steps performed in the FIG. 7(*a*) flow chart.

DETAILED DESCRIPTION OF THE PREFERRED EMBODIMENT

An illustrative embodiment of the present invention is explained hereafter with reference to the accompanying drawings.

First, the outline of a tape writer 12 to which a tape cassette 10 of the present invention is attached is explained.

Figure 3:
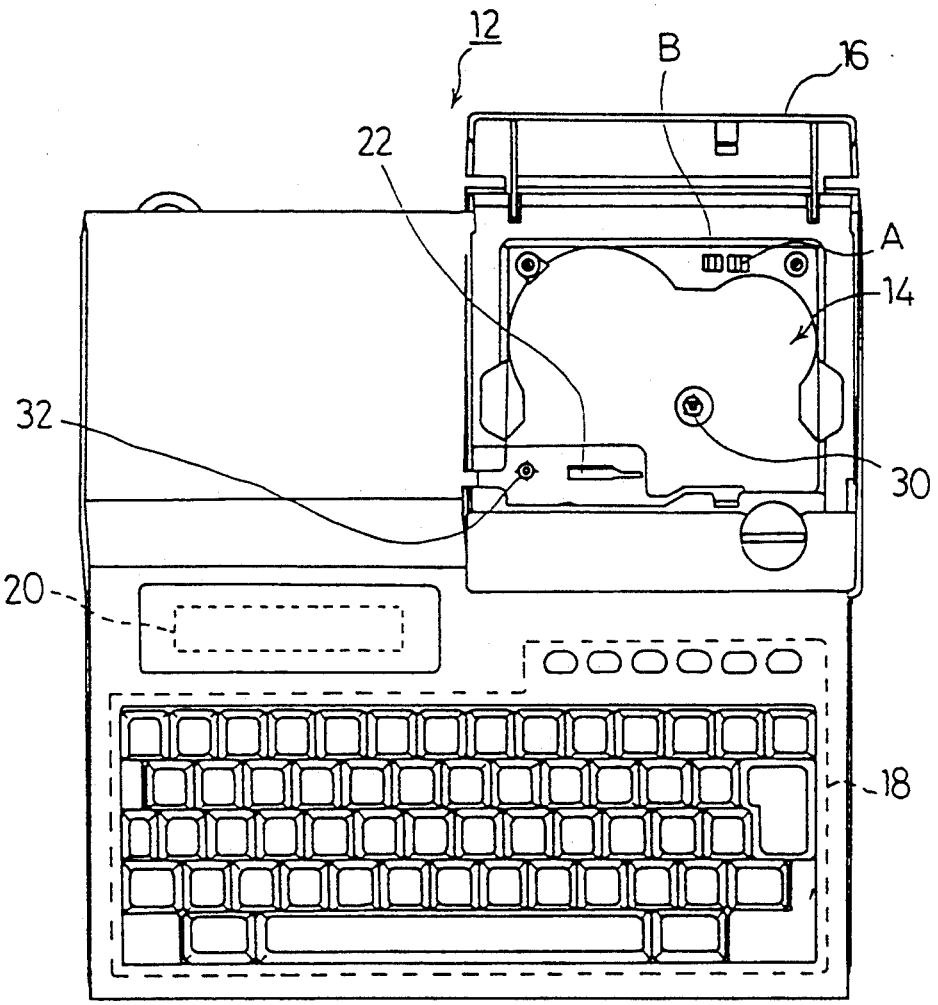
FIG. 3 is a plan view of a tape writer opening a cover of the tape cassette installation part of FIG. 2.

Key input part 18 is disposed on an upper front side (the lower side in FIG. 3) of the tape writer 12. The tape writer 12 is operated by an operator's key operation from the key input part 18. A power supply key for switching ON/OFF of the tape writer's power supply, character input key for inputting desired characters, symbols, etc., size key for setting the size of characters and symbols input by operations of character input keys, print key for printing by the print device installed in the tape writer 12, and various keys are installed on the key input part 18.

A liquid crystal display 20 is disposed in the upper left side of the key input part 18. Characters, symbols or messages input by the key input part 18 are displayed on liquid crystal display 20. A tape cassette installation part 14 is disposed above the upper right portion of the key input part 18. Tape cassette 10 described below is installed in the tape cassette installation part 14. A tape cassette 10 is attached to and detached from the tape cassette installation part 14 through an opened cover 16, which opens and closes the tape cassette installation part 14 shown in FIG. 3.

Thermal head 22, spool drive shaft 30, roller drive shaft 32, etc. are disposed in the tape cassette installation part 14. Thermal head 22 prints characters or symbols on film tape 34 by melting ink of a heat transfer ribbon 38 based on the print pattern of the characters or symbols. Thermal head 22 is installed in the front left side of the tape cassette installation part 14.

Spool drive shaft 30 and roller drive shaft 32 transmit a rotational drive by pulse motor 24 to a ribbon winding spool 26 and an adjustment roller 28 disposed in the tape cassette 10. The spool drive shaft 30 is installed almost in the center of the tape cassette installation part 14, and the roller drive shaft 32 is installed in the left side of thermal head 22. The tape cassette installation part 14 is large enough to store all kinds of tape cassettes 10 having different widths corresponding to a tape width of various tapes (film tape 34, double-coated adhesive tape 36, and heat transfer ribbon 38) stored in tape cassette 10.

A distinction sensor A or B for distinguishing a kind of tape cassette 10, a tape cutting device (not shown), etc. are installed in the tape cassette installation part 14.

Figure 4:
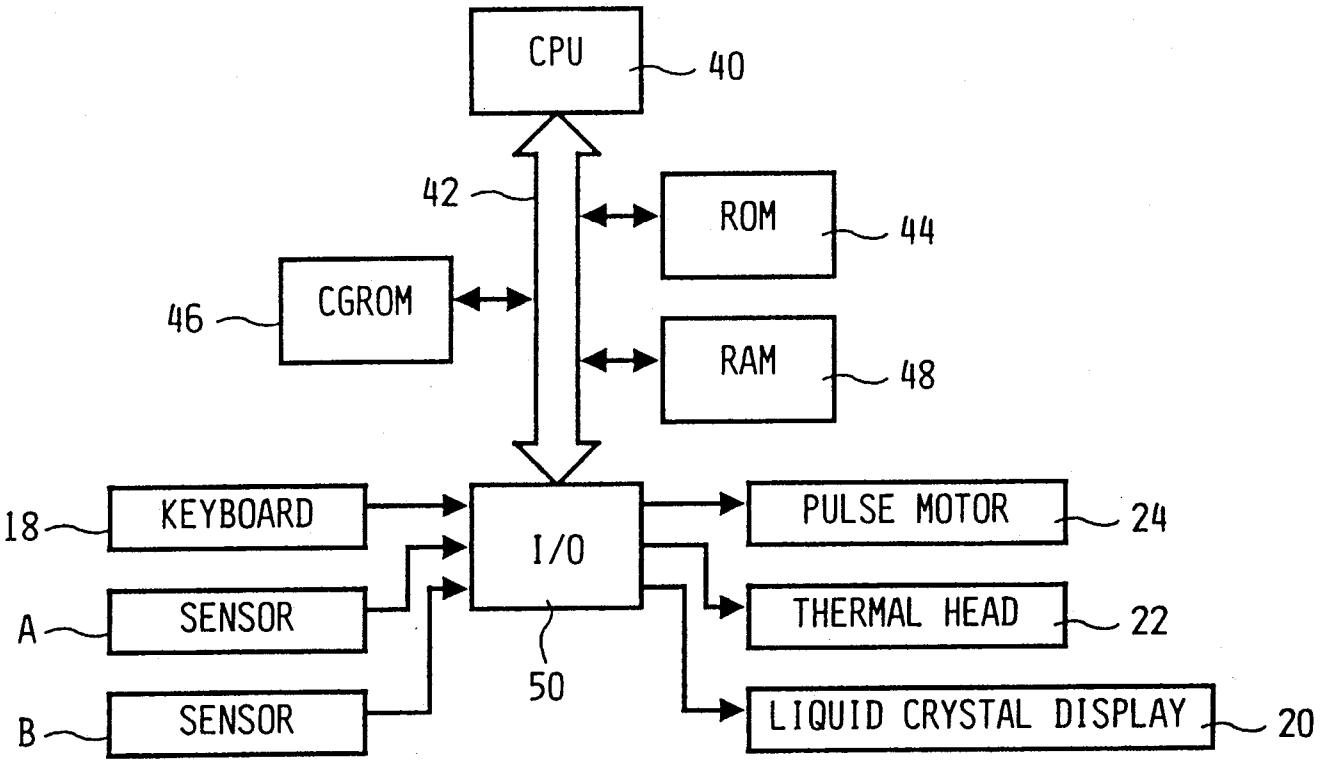
FIG. 4 is a block diagram of a control structure of a tape writer.

The structure of the control system of tape writer 12 is explained with reference to FIG. 4.

Tape writer 12 is controlled by CPU 40, and ROM 44, CGROM 46, RAM 48 and I/0 device (I/0) 50 are connected to CPU 40 via a bus 42. ROM 44 memorizes the program by which CPU 40 controls tape writer 12. Based on the program, CPU 40 controls CGROM 46 and RAM 48, and also controls pulse motor 24, thermal head 22, liquid crystal display 20, etc. connected to CPU 40 via I/0 device 50 according to the signal from key input part 18, sensor A and sensor B via I/0 device 50.

CGROM 46 memorizes print patterns of characters and symbols. CGROM 46 changes data of characters or symbols input by the control of CPU 40 into print patterns of the characters or the symbols. RAM 48 memorizes the print patterns, and RAM 48 memorizes print patterns of characters and symbols changed from data of the characters or the symbols by the control of CPU 40.

I/0 device 50 connects CPU 40, the input device of key input part 1B, sensor A, sensor B, etc., and the output device of pulse motor 24, thermal head 22, liquid crystal display 20, etc. I/0 device 50 changes signals from the input device into a form that CPU 40 can read, and I/0 device 50 changes signals from CPU 40 into a form enabling each output device to execute its operation.

Next, the structure of tape cassette 10 of the present invention attached to tape writer 12 of the above-mentioned structure is explained.

Tape cassette 10 which stores supply spools and winding spools of tapes and ribbons (film tape 34, double-coated adhesive tape 36, and heat transfer ribbon 38) is installed detachably in the tape cassette installation part 14.

Space 54 is formed in tape cassette 10 so that thermal head 22 can be provided in the space 54 when the tape cassette 10 is attached to the tape cassette installation part 14.

Double-coated adhesive tape spool 56 is rotatably installed in the upper direction of the space 54. One side of double-coated adhesive tape 36 is covered with an exfoliative sheet, and double-coated adhesive tape 36 is wound counterclockwise around the double-coated adhesive tape spool 56 with the exfoliative sheet facing outside.

Adjustment roller 28 is rotatably installed in the left side of space 54.

The adjustment roller 28 is engaged with roller drive shaft 32 on the tape writer 12 and the adjustment roller 28 is driven clockwise by roller drive shaft 32, when tape cassette 10 is attached to the tape cassette installation part 14. The double-coated adhesive tape 36 wound around the double-coated adhesive tape spool 56 is engaged to the adjustment roller 28 clockwise with its exfoliative sheet facing inside. The double-coated adhesive tape 36 is sent off to exit 58 by the clockwise rotation of the adjustment roller 28.

Ribbon winding spool 26 is rotatably installed in the upper right direction of space 54. When tape cassette 10 is attached to the tape cassette installation part 14, the ribbon winding spool 26 is engaged to spool drive shaft 30 on tape writer 12 and the ribbon winding spool 26 is driven to rotate counterclockwise by the spool drive shaft 30.

Ribbon supplying spool 60 is rotatably installed in the lower right direction of ribbon winding spool 26. Heat transfer ribbon 38 having almost the same width as double-coated adhesive tape 36 is wound around the ribbon supplying spool 60 counterclockwise with its ink surface facing inside. The heat transfer ribbon 38 wound around the ribbon supplying spool 60 is led to thermal head 22 by guides 62 and 64 with its ink surface facing outside, and it is led to ribbon winding spool 26 by guides 66, 68, and 70 with its ink surface facing inside. Since the rotational drive of spool drive shaft 30 by pulse motor 24 rotates ribbon winding spool 26 counterclockwise, the heat transfer ribbon 38 led to ribbon winding spool 26 is wound by the rotation.

Film tape spool 72 is rotatably installed in the upper right direction of the ribbon winding spool 26. Transparent film tape 34 of the same width as double-coated adhesive tape 36 is wound around the film tape spool 72 in a clockwise direction. The film tape 34 wound around the film tape spool 72 is led to the outside of the heat transfer ribbon 38 on the thermal head 22 by guides 74 and 64. Subsequently, the film tape 34 is led to the outside of the double-coated adhesive tape 36 on adjustment roller 28 by guide 76, and the film tape 34 is adjusted with the double-coated adhesive tape 36, and the film tape 34 is then sent off to the exit 58 with the double-coated adhesive tape 36.

Support portion 92 is supported pivotably to tape, cassette 10 around shaft 90 disposed on tape write 12. Platen roller 94 is pivotably disposed on the support portion 92 confronting thermal head 22 via heat transfer ribbon 38 and film tape 34. Feeding roller 96 is rotatably disposed on the support portion 92 confronting adjustment roller 28 via double-coated adhesive tape 36 and film tape 34. Platen roller 94 is pressed against the support portion 92 when the support portion 92 is selectively biased by the bias member(not shown), and feeding roller 96 is pressed against adjustment roller 28.

Second projection part 80 described below is installed in the upper left direction of film tape spool 72 of lower casing 78. Hole 82 is located in the right side of the second projection part 80. First projection part 84 is installed on upper casing 52 (not shown). The first projection part 84 projects its top through the hole 82 to the outside of tape cassette 10.

Figure 1:
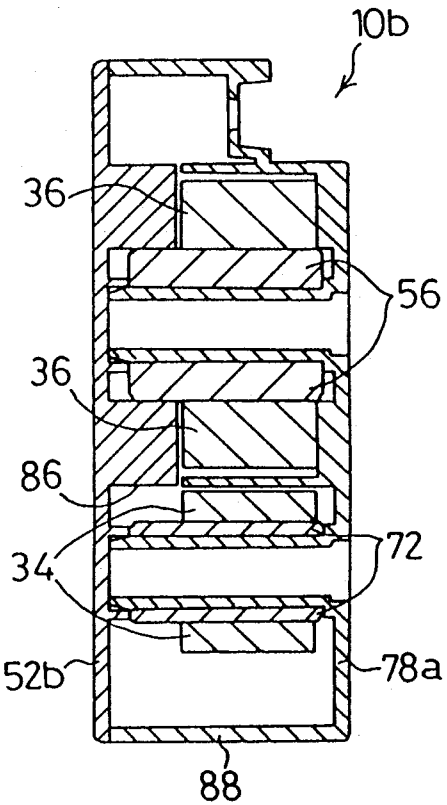
FIG. 1(*a*) is a cross-sectional view of a cassette casing storing a tape of 24 mm width.
Figure 1:
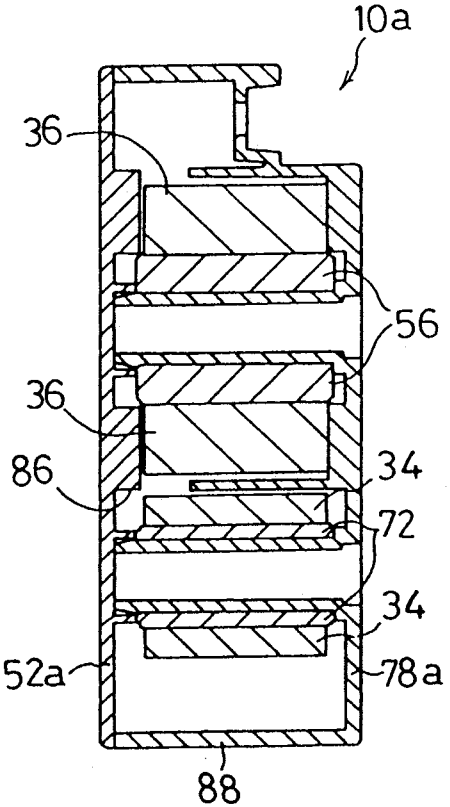
Figure 1:
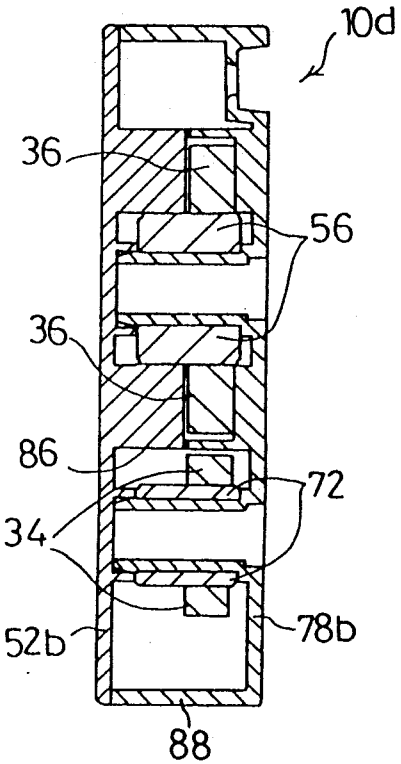
Figure 1:
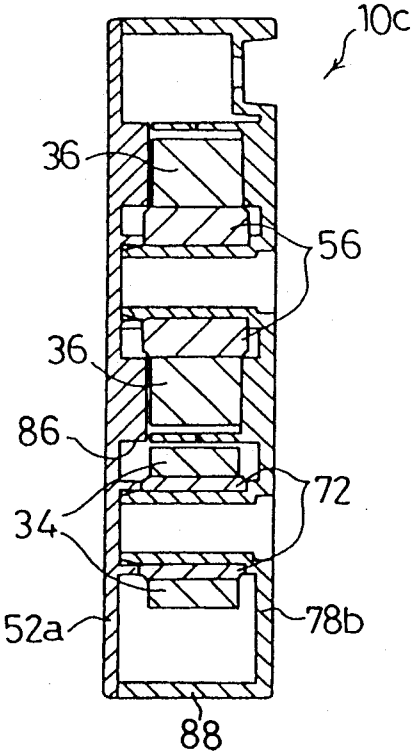
Figure 2:
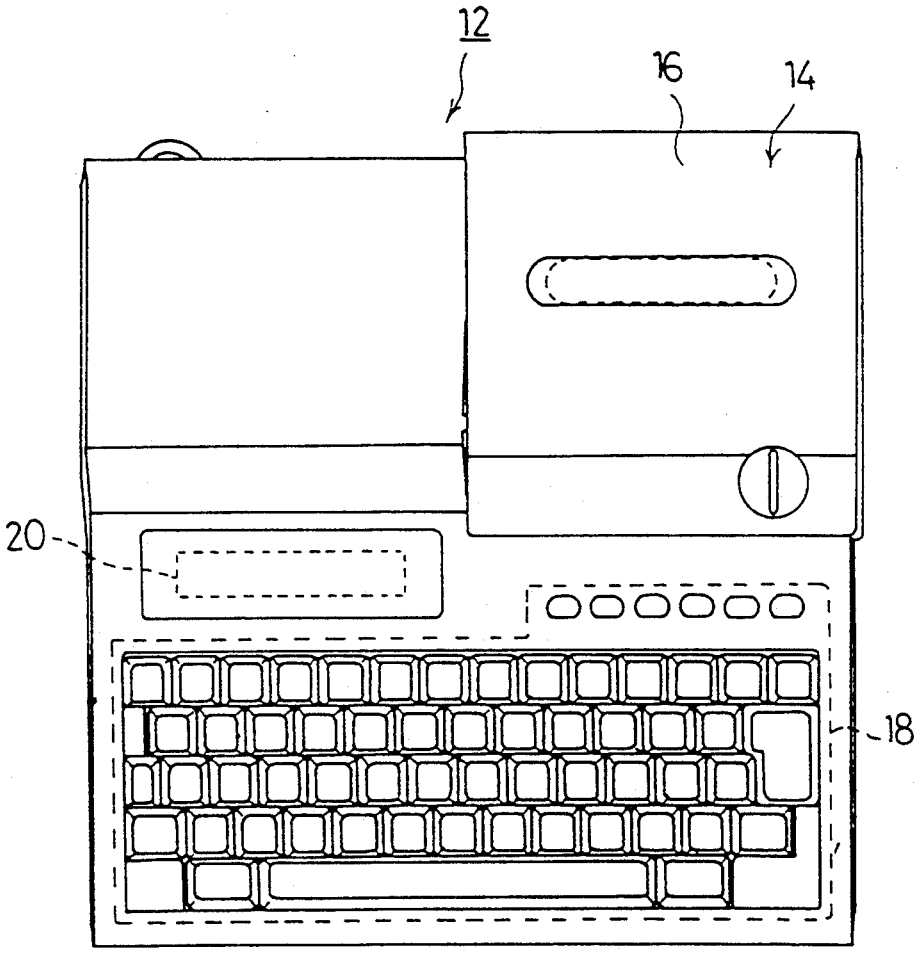
FIG. 2 is a plan view of a tape writer seen from the upper side.
Figure 5:
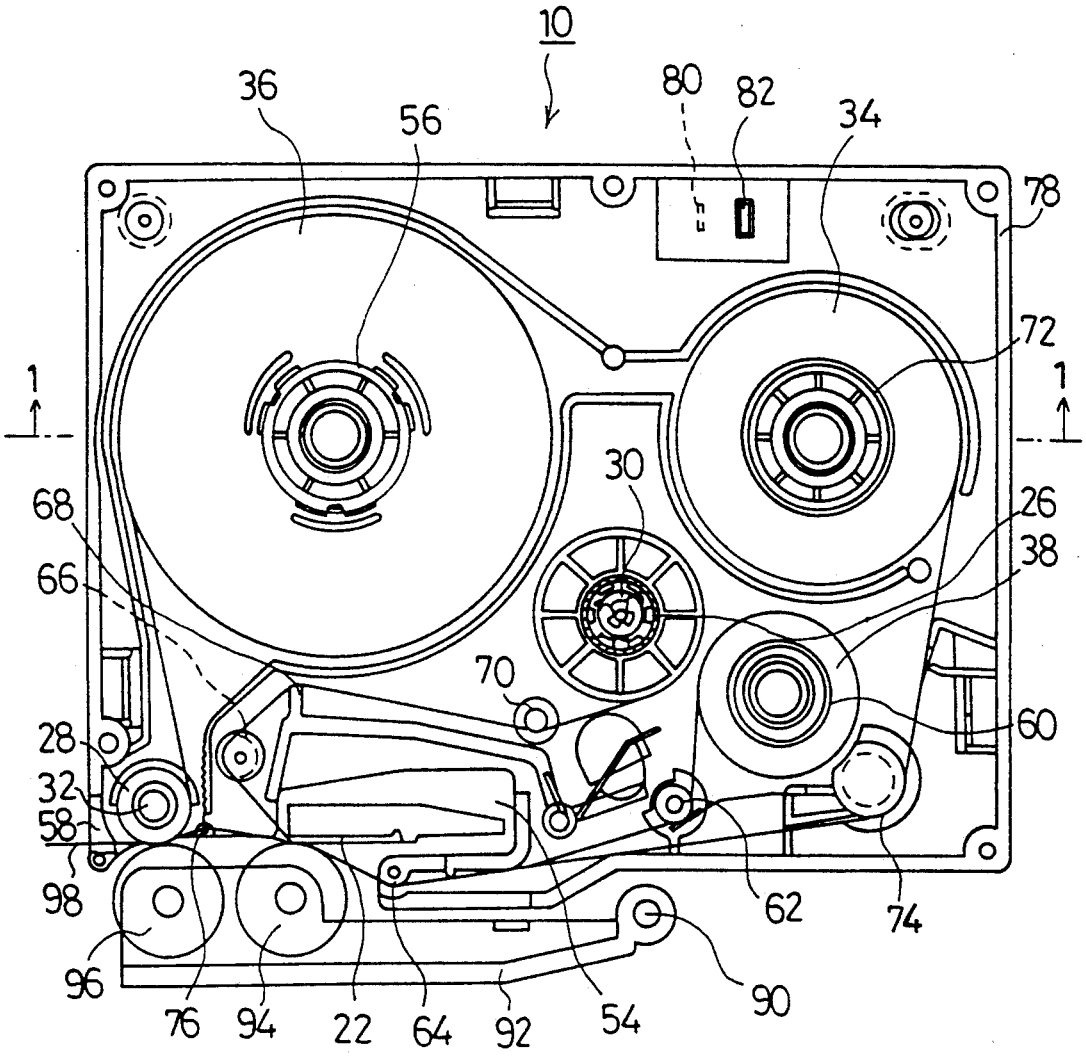
FIG. 5 is a plan view of the main part of a tape cassette without an upper casing installed in the tape cassette installation part.

As shown in the cross-sectional view (FIGS. 1(*a*)-(*d*) of 1—1 line shown in FIG. 5, tape cassette 10 of the above-mentioned structure is formed by combining either one of upper casing 52*a* or upper casing 52*b* whose guide ribs 86 have heights which differ by 6 mm and either one of lower casing 78*a* or lower casing 78*b* whose spools and outer walls 88 have heights which differ by 12 mm from one another corresponding to the tape width of the tape installed in tape cassette 10.

For example, the height of guide ribs 86 of upper casing 52*a* and upper casing 52*b* differ by 6 mm from each other, and the height of guide rib 86 of upper casing 52*a* is 6 mm lower than that of upper casing 52*b*. Among tape cassettes 10 formed by the upper casing 52*a* or 52*b*, tape cassette 10*a* for storing tapes (film tape 34, double-coated adhesive tape 36, heat transfer ribbon 38) of 24 mm width is formed by combining upper casing 52*a* and lower casing 78*a*. Tape cassette 10*b* for storing tapes (film tape 34, double-coated adhesive tape 36, heat transfer ribbon 38) of 18 mm width is formed by combining upper casing 52*b* and lower casing 78*a*.

Thus, lower casing 78*a* can form both tape cassette 10*a* for storing tapes (film tape 34, double-coated adhesive tape 36, heat transfer ribbon 38) of 24 mm width and tape cassette 10*b* for storing tapes (film tape 34, double-coated adhesive tape 36, heat transfer ribbon 38) of 18 mm width.

On the other hand, the height of spools and outer walls 88 of lower casing 78*a* and the height of those of lower casing 78*b* differ by 12 mm, and the height of spools and outer walls 88 of lower casing 78*a* are higher than the height of those of lower casing 78*b*. Therefore, among tape cassettes 10 formed by lower casing 78*b* whose spools and outer walls 88 are lower than those of lower casing 78*a* by 12 mm and upper casing 52*a* or 52*b*, tape cassette 10*c* storing tapes of (film tape 34, double-coated adhesive tape 36, heat transfer ribbon 38) 12 mm width is formed by combining upper casing 52*a* and lower casing 78*b*. Tape cassette 10*d* storing tapes (film tape 34, double-coated adhesive tape 36, heat transfer ribbon 38) of 6 mm width is formed by combining upper casing 52*b* and lower casing 78*b*.

Thus, lower casing 78*b* can form tape cassette 10*c* for storing tapes (film tape 34, double-coated adhesive tape 36, heat transfer ribbon 38) of 12 mm width and tape cassette 10*d* for storing tapes (film tape 34, double-coated adhesive tape 36, heat transfer ribbon 38) of 6 mm width.

Four kinds of tape cassettes (10*a*, 10*b*, 10*c*, 10*d*) for storing various kind tapes (24 mm, 18 mm, 12 mm, 6 mm, respectively) whose tape widths are different by 6 mm from each other can be formed by combining each of the two kinds of upper casings 52*a* and 52*b* and two kinds of lower casings 78*a* and 78*b*.

The explanation of tape writer 12 to which tape cassette 10 is attached is provided hereafter.

Second projection part 80 of tape cassette 10 is formed corresponding to a kind of lower casing 78. That is, the second projection part 80*a* of lower casing 78*a* does not extend to the outside of tape cassette 10. On the other hand, second projection part 80*b* of lower casing 78*b* projects its top to the outside of tape cassette 10 (lower direction of tape cassette 10 shown in FIG. 5).

When tape cassette 10*c* or 10*d* formed by lower casing 78*b* having second projection part 80*b* which projects its top to the outside of tape cassette 10 is attached to tape writer 12, the second projection part 80*b* is inserted into the hollow of sensor B disposed on the tape writer 12. When tape cassette 10*a* or 10*b* formed by lower casing 78*a* having second projection part 80*a* which does not extend to the outside of tape cassette 10 is attached to tape writer 12, the second projection part 80*a* is therefore not inserted into the hollow of sensor B disposed on the tape writer 12.

On the other hand, first projection part 84 of tape cassette 10 is formed corresponding to a kind of upper casing 52. That is, first projection part 84*a* of upper casing 52*a* projects its top through hole 82 of lower casing 78 to the outside of tape cassette 10 (lower direction of tape cassette 10 shown in FIG. 5), and first projection part 84*b* of upper casing 52*b* does not extend to the outside of tape cassette 10.

When tape cassette 10*a* or 10*c* formed by upper casing 52*a* having first projection part 84*a* which projects its top to the outside of tape cassette 10 is attached to tape writer 12, the first projection part 84*a* is inserted into the hollow of sensor A disposed on tape writer 12. When tape cassette 10*b* or 10*d* formed by upper casing 52*b* having first projection part 84*b* which does not project its top to the outside of tape cassette 10 is installed in tape writer 12, the first projection part 84*b* is not inserted into the hollow of sensor A disposed on tape writer 12.

Each of sensor A and sensor B which is the main element of the distinction means for distinguishing the kind of tape cassette 10 has a luminescence part and a receiving part of infrared radiation corresponding to first projection part 84 and the second projection part 80. Electric current is changed to infrared radiation and infrared radiation is generated in the luminescence part of sensor A (or sensor B). If infrared radiation is received in the receiving part, an electric charge is generated in the receiving part of sensor A (or sensor B).

Since the first projection part 84*b* (or second projection part 80*a*) is not inserted into the hollow of sensor A (or sensor B) when tape cassette 10 having first projection part 84*b* (or second projection part 80*a*) is attached to tape writer 12, the infrared radiation generated in the luminescence part is received in the receiving part. However, since the first projection part 84*b* (or second projection part 80*b*) is inserted into the hollow of sensor A (or sensor B) when tape cassette 10 having the first projection part 84*b* (or second projection part 80*b*) is attached to tape writer 12, the infrared radiation generated in the luminescence part is cut off by first projection part 84*a* (or second projection part 80*b*), and the infrared radiation is not received in the receiving part.

The generation of an electric charge is determined by whether infrared radiation is received in the receiving part or not, and the kind of upper casing 52 (or lower casing 78) is distinguished by the generation of the electric charge. The kind of cassette case 10 is distinguished by the combination of the distinguished upper casing 52 and lower casing 78.

Installation and use of above-mentioned tape cassette 10 attached to tape writer 12 for making a tape 98 on which desired characters and symbols are printed will now be explained.

First, tape cassette 10 storing tapes (film tape 34, double-coated adhesive tape 36, heat transfer ribbon 38) of desired tape width is attached to tape cassette installation part 14, and the power supply of tape writer 12 is turned on by an operator.

Figure 6:
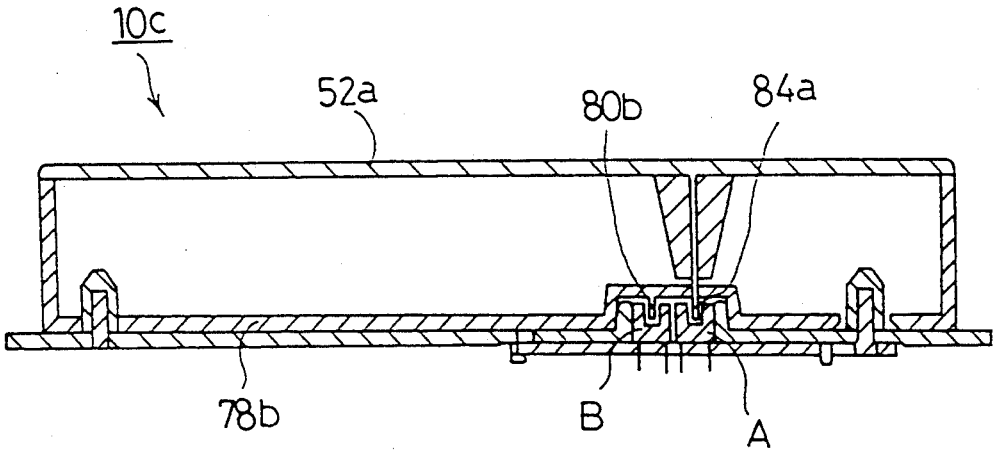
FIG. 6 is a cross-sectional view of a tape cassette showing projections and sensors of the installation of a tape cassette in the tape cassette installation part.

For example, tape cassette 10*c* storing a tape of 12 mm width is attached to tape writer 12. Tape cassette 10*c* is formed by upper casing 52*a* and lower casing 78*b* as shown in FIG. 1. Both of the first projection part 84*a* and the second projection part 80*b* project their tops to the outside of the cassette casing 10*c* as shown in FIG. 6.

When characters or symbols are input from key input part 18 by an operator, CPU 40 of tape writer 12 reads the input characters or symbols via I/0 device 50 and displays them on liquid crystal display 20.

Next, if the print key is pressed and the signal from the print key is sent to CPU 40, infrared radiation is generated in the luminescence parts of sensor A and sensor B by the signal from CPU 40 according to the program memorized in ROM 44. When infrared radiation is generated, CPU 40 checks whether an electric charge is generated in the receiving part or not. Since first projection part 84*a* and second projection part 80*b* of tape cassette 10*c* are inserted into the hollows of sensor A and sensor B respectively, an electric charge is not generated in the receiving parts of sensor A and sensor B. As a result, CPU 40 identifies the kind of the installed tape cassette 10 as tape cassette 10*c* because CPU 40 reads that an electric charge is not generated in the radiation receiving parts of sensor A and sensor B.

After the tape cassette 10*c* is identified as tape cassette 10*c*, CPU 40 determines whether the size of the input characters or symbols fit in the tapes (film tape 34, double-coated adhesive tape 36, heat transfer ribbon 38) of 12 mm width stored in tape cassette 10*c*. If the character size fits in the tape width, the characters or symbols are printed, and if the character size does not fit in the tape width, an error display appears on the display 20.

Figure 7A:
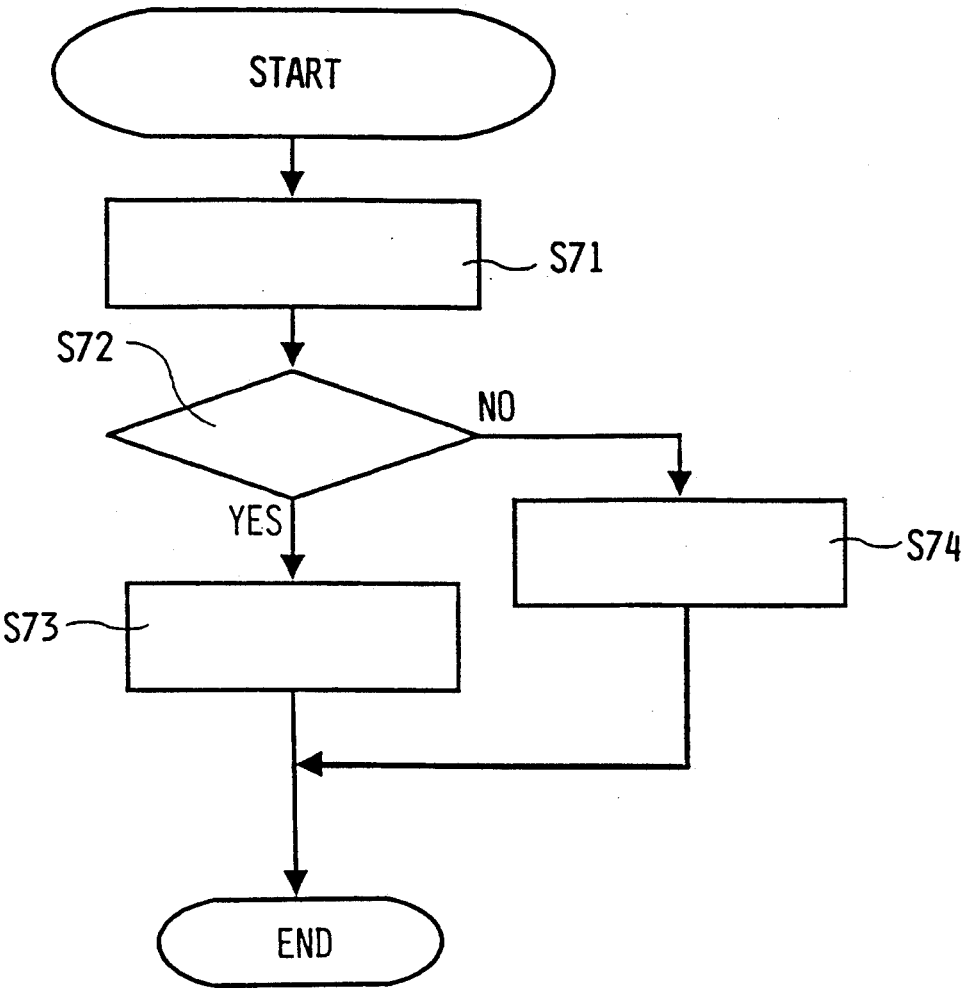
FIG. 7(*a*) is a flow chart illustrating an operation sequence when input character size is larger than tape size.

FIGS. 7(*a*) and 7(*b*) illustrate an operation sequence when character size set by the size key does not fit within the tape of the installed tape cassette case 10. In step S71, CPU 40 identifies the installed tape cassette. The CPU 40 then determines in step S72 whether the size of input characters fits within the tape size of the installed cassette case 10. If the character size fits (step S72:YES), characters are printed on the tape in step S73. If, however, the character size does not fit (step S72:NO) an error message is displayed in step S74.

For example, it is assumed that the character size in which characters or symbols are printed using a full width of 24 mm is input from key input part 18, although tape cassette 10*c* storing tapes (film tape 34, double-coated adhesive tape 36, heat transfer ribbon 38) of 12 mm width is attached to tape writer 12.

In this case, since a part of thermal head 22 contacts platen roller 94 directly, if printing is started, a part of thermal head 22 which contacts with platen roller 94 directly also generates heat. As a result, the part of platen roller 94 which contacts the thermal head 22 directly is damaged and thermal head 22 may be broken down. Therefore, printing is not executed in this case, and messages such as, for example, "inappropriate character size" or "impossible to print" are displayed on the display and signal an operator to change the input character size, or to exchange the installed tape cassette 10*c* with tape cassette 10*a* storing tapes (film tape 34, double-coated adhesive tape 36, heat transfer ribbon 38) of 24 mm width. By displaying messages on the display to signal an operator, damage to platen roller 94 and break down of thermal head 22 are prevented.

On the other hand, when the character size fits in the tape width, the data of input characters or symbols is changed to the print pattern by CGROM 46 and the print pattern is memorized in RAM 48 by signals from CPU 40. Then, CPU 40 controls the speed or the amount of rotational drive of adjustment roller 28 and ribbon winding spool 26 by controlling pulse motor 24. As a result, CPU 40 controls the speed and the feeding amount of double-coated adhesive tape 36 engaged to the adjustment roller 28, film tape 34 bonded to the double-coated adhesive tape 36, and heat transfer ribbon 38 wound around ribbon winding up spool 26. At the same time, CPU 40 also controls the generation of heat from thermal head 22, and the print pattern stored in RAM 48 is printed from heat transfer ribbon 38 between thermal head 22 and platen roller 94 to film tape 34.

The print surface of film tape 34 and the adhesive surface of the double-coated adhesive tape 36 are adjusted by adjustment roller 28 and feeding roller 96 pressed against the adjustment roller 28 sandwiching film tape 34 and double-coated adhesive tape 36. The tape 98 adjusted between the adjustment roller 28 and feeding roller 96 is fed to exit 58 and sent outside of tape writer 12 by rotational drive of the adjustment roller 28.

When the tape 98 extended out of tape writer 12 is cut off from tape 98 inside tape writer 12 by the tape cutting device installed in tape writer 12, the process of making a tape 98 (a piece of tape) on which desired characters or symbols are printed is completed.

It is to be understood that the present invention is not restricted to the particular forms shown in the foregoing embodiment. Various modifications and alterations can be made thereto without departing from the scope of the inventions encompassed by the appended claims.

For example, although tapes installed in each of tape cassettes 10*a*, 10*b*, 10*c* and 10*d* in this embodiment have tape widths of 24 mm , 18 mm, 12 mm, and 6 mm tape width, respectively, tapes of tape width other than 24 mm, 18 mm, 12 mm, and 6 mm are permitted to be used, and the difference between tape width is not restricted to 6 mm.

Two kinds of upper casings 52 of tape cassette 10 and two kinds of lower casings 78 of tape cassette 10 are used in the embodiment. However, tape cassette 10 storing tapes (film tape 34, double-sided adhesive tape 36, heat transfer ribbon 38) of the same width can be formed by using more than two kinds of upper casings 52 or more than two kinds of lower casings 78, even if there are tapes of more than five kinds of tape width. In this case, the number of sensors is increased to identify tape cassette 10, and a plurality of projection parts (non-projection part) corresponding to each kind of upper casings 52 or lower casings 78 are formed in first projection part 84 of upper casing 52 or second projection part 80 of lower casing 78.

If the input character size does not fit in the installed tape cassette 10, an error display on display 20 informs an operator of the error and to change character size or exchange tape cassette 10. However, it is allowed to change character size which fits in the tape cassette 10 and print automatically.

What is claimed is:

1. A tape cassette kit for attachment to a tape writer for making a tape on which desired characters or symbols are printed, comprising:

means for accommodating tapes of different widths, said means including:

a plurality of different upper casings; and a plurality of different lower casings, each of said upper casings and each of said lower casings being combinable with one another to provide a plurality of cassettes having compartments for storage of tapes of different widths, wherein one of said upper casings in combination with one of said lower casings stores on tape width and said one of said upper casings in combination with a different one of said lower casings stores a tape width different than said one tape width.

2. The tape cassette kit according to claim 1, wherein said upper casings having guide ribs, said guide ribs defining a size of said annular compartments corresponding to tape width.

3. The tape cassette kit according to claim 1, wherein said lower casings have spools and outer walls, said spools and outer walls defining a size of said annular compartments corresponding to tape width.

4. The tape cassette kit according to claim 1, wherein each upper casing and each lower casing has a projection part, each projection part indicating a size of said annular compartments corresponding to tape width.

5. The tape writer for making a tape on which desired characters or symbols are printed, comprising:

a print mechanism for printing said desired characters or symbols on said tape;

tape feeding means for feeding said tape to said print mechanism for printing;

means for accommodating tapes of different widths, said means including a plurality of different upper casing and a plurality of different lower casings;

a tape cassette including:

an upper casing selected from said plurality of upper casings; and a lower casing selected from said plurality of lower casings, each of said plurality of upper casings and each of said plurality of lower casings being combinable with one another to provide a plurality of cassettes, each of said cassettes having annular compartments for storage of tape of a different width, wherein one of said plurality of upper casings in combination with one of said plurality of lower casings stores one tape width and said one of said plurality of upper casings in combination with a different one of said plurality of lower casings stores a tape width different than said one tape width; and sensor means for distinguishing a type of upper casing and a type of lower casing in said tape cassette.

6. The writer according to claim 5, wherein said upper casing has at least one guide rib, said guide rib defining a size of said annular compartments in said tape cassette.

7. The tape writer according to claim 5, wherein said lower casing has at least one spool and outer wall, said spool and outer wall defining a size of said annular compartments in said tape cassette.

8. The tape writer according to claim 5, wherein said upper casing has a first projection part and said lower casing has a second projection part, each projection part indicating a size of said annular compartments corresponding to tape width.

9. The tape writer according to claim 8, wherein said sensor means distinguishes said casing types by detecting said projection parts.

10. The tape writer according to claim 9, wherein said sensor means comprises an individual sensor for detecting a respective one of said first and second projection parts.

11. The tape writer according to claim 10, wherein said sensor means comprises a luminescence part and a radiation receiving part, said sensor means distinguishing said casing types by determining whether radiation is received at said radiation receiving part.

12. The tape writer according to claim 11, wherein said radiation receiving part is an infrared radiation receiving part, said sensor means distinguishing said casing types by determining whether infrared radiation is received at said infrared radiation receiving part.

13. The tape writer according to claim 5, further comprising character size selection means for selecting a character size and processing means for identifying tape cassette type based on a signal from said sensor means and determining whether the selected character size fits within a tape of said identified tape cassette type.

14. The tape writer according to claim 13, further comprising indication means for indicating when said processing means determines that the selected character size does not fit within said tape of said identified tape cassette type.

15. A tape cassette for attachment to a tape writer for making a tape on which desired characters or symbols are printed, comprising:

means for accommodating tapes of different widths, said means including:

a plurality of different upper casings; and a plurality of different lower casings, each of said plurality of upper casings and each of said plurality of lower casings being combinable with one another to provide a plurality of cassettes having compartments, each of said cassettes for storage of tape of a different width, wherein one of said upper casings in combination with one of said lower casings stores one tape width and said one of said upper casings in combination with a different one of said lower casings stores a tape width different than said one tape width.

16. The tape cassette according to claim 15, wherein each of said plurality of upper casings has at least one guide rib, said guide rib defining a size of said annular compartments in said tape cassette.

17. The tape cassette according to claim 15, wherein said lower casing has at least one spool and outer wall, said spool and outer wall defining a size of said annular compartments in said tape cassette.

18. The tape cassette according to claim 15, wherein said upper casing has a first projection part and said lower casing has a second projection part, each projection part indicating a size of said annular compartments corresponding to tape width.

19. The tape cassette for attachment to a tape writer for making a tape on which desired characters or symbols are printed, comprising:

means for accommodating tapes of different widths, said means including:

a plurality of upper casings; and a plurality of different lower casings, each of said plurality of upper casings and each of said plurality of lower casings being combinable with one another to provide a plurality of cassettes having compartments, each of said cassettes for storage of tape of a different width, wherein one of said upper casings in combination with one of said lower casings stores one tape width and said one of said upper casings in combination with a different one of said lower casings stores a tape width different than said one tape width.

20. The tape cassette for attachment to a tape writer for making a tape on which desired characters or symbols are printed, comprising:

means for accommodating tapes of different widths, said means including:

a plurality of different upper casings; and a plurality of lower casings, each of said plurality of upper casings and each of said plurality of lower casings being combinable with one another to provide a plurality of cassettes having compartments, each of said cassettes for storage of tape of a different width, wherein one of said upper casings in combination with one of said lower casings stores one tape width and said one of said upper casings in combination with a different one of said lower casings stores a tape width different than said one tape width.

* * * * *